US009476284B2

(12) United States Patent
Al-Rabeh et al.

(10) Patent No.: US 9,476,284 B2
(45) Date of Patent: Oct. 25, 2016

(54) APPARATUS AND METHODOLOGY FOR CONTINUOUS DOWN HOLE SAND SCREEN FILL REMOVAL

(71) Applicant: Saudi Arabian Oil Company, Dhahran (SA)

(72) Inventors: Majed N. Al-Rabeh, Dhahran (SA); Bandar H. Al-Malki, Abdullah Foad District (SA)

(73) Assignee: SAUDI ARABIAN OIL COMPANY (SA)

( * ) Notice: Subject to any disclaimer, the term of this patent is extended or adjusted under 35 U.S.C. 154(b) by 309 days.

(21) Appl. No.: 14/313,420

(22) Filed: Jun. 24, 2014

(65) Prior Publication Data

US 2015/0369012 A1 Dec. 24, 2015

(51) Int. Cl.

| | |
|---|---|
| ***E21B 37/08*** | (2006.01) |
| ***E21B 43/02*** | (2006.01) |
| ***E21B 4/02*** | (2006.01) |
| ***E21B 23/02*** | (2006.01) |
| ***E21B 33/12*** | (2006.01) |

(52) U.S. Cl.

CPC ..... *E21B 37/08* (2013.01); *E21B 4/02* (2013.01); *E21B 23/02* (2013.01); *E21B 33/12* (2013.01); *E21B 43/025* (2013.01)

(58) Field of Classification Search

USPC ..... 166/376, 171

See application file for complete search history.

(56) References Cited

U.S. PATENT DOCUMENTS

| | | | | |
|---|---|---|---|---|
| 3,361,203 | A | 1/1968 | Rensvold | |
| 3,446,283 | A | 5/1969 | Baumstimler | |
| 3,561,605 | A | 2/1971 | Likness | |
| 3,750,885 | A | 8/1973 | Fournier | |
| 3,901,320 | A | 8/1975 | Calderon et al. | |
| 4,059,155 | A | 11/1977 | Greer | |
| 4,180,463 | A | 12/1979 | Calderon | |
| 4,200,150 | A * | 4/1980 | Saadeh | B01D 29/48 166/231 |
| 4,227,576 | A | 10/1980 | Calderon | |
| 4,237,978 | A | 12/1980 | Calderon et al. | |
| 4,260,016 | A * | 4/1981 | Calderon | B01D 25/32 166/205 |
| 4,515,212 | A | 5/1985 | Krugh | |
| 5,076,355 | A * | 12/1991 | Donovan | E21B 17/22 166/242.1 |
| 6,520,271 | B1 * | 2/2003 | Martini | E21B 21/103 175/107 |
| 6,613,154 | B1 | 9/2003 | Lester | |
| 8,479,821 | B2 * | 7/2013 | Crawford | B08B 9/0557 166/311 |
| 8,727,009 | B2 * | 5/2014 | Davis | E21B 21/08 166/105.2 |

(Continued)

FOREIGN PATENT DOCUMENTS

| | | |
|---|---|---|
| DE | 8801702 U1 | 4/1988 |
| DE | 9007432 U1 | 8/1991 |

(Continued)

OTHER PUBLICATIONS

PCT International Search Report and The Written Opinion of the International Searching Authority dated Oct. 2, 2015; International Application No. PCT/US2015/037305; International Filing Date: Jun. 24, 2015.

*Primary Examiner* — Taras P Bemko
(74) *Attorney, Agent, or Firm* — Bracewell LLP; Constance Gall Rhebergen

(57) ABSTRACT

An apparatus for continuous removal of fill in a sand screen in a down hole environment is provided, as well as methods of using the apparatus in a continuous fashion such that accumulation of fill is prevented in a sand screen in a down hole environment.

7 Claims, 2 Drawing Sheets

(56) References Cited

U.S. PATENT DOCUMENTS

| | | | | |
|---|---|---|---|---|
| 9,248,478 | B2 * | 2/2016 | Crawford | B08B 9/0557 |
| 2009/0151942 | A1 | 6/2009 | Bernardi, Jr. | |
| 2010/0288492 | A1 * | 11/2010 | Blackman | E21B 27/005 166/250.01 |
| 2013/0168091 | A1 | 7/2013 | Xu et al. | |
| 2014/0166305 | A1 * | 6/2014 | Grigor | E21B 29/002 166/376 |

FOREIGN PATENT DOCUMENTS

| | | | |
|---|---|---|---|
| DE | 102006010189 | A1 | 9/2007 |
| WO | 2010139931 | A2 | 12/2010 |

* cited by examiner

APPARATUS AND METHODOLOGY FOR CONTINUOUS DOWN HOLE SAND SCREEN FILL REMOVAL

FIELD OF THE INVENTION

This invention generally relates to down hole sand screen fill removal tools. More specifically, this invention relates to tools for down hole sand screen fill removal that are energized by oil or gas flow inside the completion to continuously prevent the accumulation of sand screen fill.

BACKGROUND OF THE INVENTION

In the oil and gas industry, wells are drilled to target hydrocarbon bearing formations for future production. The wells are drilled using drilling mud which cools and lubricates the drilling bit, among other things. In many instances, the drilling mud includes $CaCO_3$ or "calcite" as a weighting material to increase the density of drilling mud. This calcite can invade the hydrocarbon bearing formation during the drilling stage of the well and, after the well is put on production, the calcite will flow back inside the well and may deposit with formation rock inside the sand screens.

Hydrocarbon formations are characterized by different lithologies such as carbonate or sand stone rock formations. The sandstone formations may be unconsolidated meaning that sand production is expected once the well is put into production. Sand production has historically been problematic as it causes the erosion of down hole and surface equipment. In order to mitigate the issue of sand production in unconsolidated sandstone formations, sand screens are deployed as part of the lower well completions across the sand face.

Over time sand screens can experience accumulation of calcite, or fill. The fill negatively impacts production from the well and reduces production by restricting the flow of gas from the reservoir and plugging sand screens.

The current method for removing fill accumulations from sand screens is to deploy coiled tubing fill clean out operations. In such an operation, the Christmas tree (series of valves on top of the wellhead and known to those skilled in the art) is removed and replaced with a temporary blow out preventer to allow safe wellbore intervention. Then, a milling tool that is attached to coiled tubing and operated by a motor is run down hole and is used to drill out the fill accumulation and circulate the cuttings to surface. However, this is not a permanent solution to the problem as the fill may re-accumulate, thus requiring another deployment. Furthermore, the costly coiled tubing milling operations require shutting down the well, causing interruptions in well production. Therefore, a permanent solution is needed to prevent the accumulation of fill in sand screens.

SUMMARY

In some embodiments, the invention provides a continuous down hole sand screen fill removal apparatus. The apparatus includes a perforated component having perforations that are operable to allow the flow of reservoir fluids, The perforated component also has a top perforated component portion and a bottom perforated component portion. The apparatus also has a transition component (Cross-over) that has a top transition component portion having a top transition component portion outer diameter and a bottom transition component portion having a bottom transition component portion outer diameter that is less than the top transition component portion outer diameter. The apparatus also has a shaft component that has a distal shaft component portion and a proximal shaft component portion. The shaft may incorporate small blades on its inner surface to break accumulations of fill inside the shaft. The apparatus further includes a swivel component that is operable to rotate the shaft component without rotating the perforated component. The swivel component has a top swivel component portion and bottom swivel component portion. The apparatus also includes at least one turbine component and a mill component that is operable to remove fill in a sand screen.

In the apparatus, the bottom perforated component portion is adapted to be connected to the top transition component portion. The bottom transition component portion is adapted to be connected to the top swivel component portion. The proximal shaft component portion is adapted to be connected to the bottom swivel component portion. The at least one turbine component is coupled to the shaft component such that the at least one turbine component is operable to rotate the shaft component. The mill component is adapted to be connected to the distal shaft component portion. The apparatus is adapted to be placed in a sand screen in a down hole environment.

In another embodiment, the invention provides a method of using the continuous down hole sand screen fill removal apparatus. The method includes the steps of placing the continuous down hole sand screen fill removal apparatus in a sand screen in a wellbore in a down hole region and then allowing the flow of a gas from the down hole region across the continuous down hole sand screen fill removal apparatus causing the at least one turbine component to rotate the shaft component. Additionally, the rotation of the shaft component operates in such a fashion to rotate the mill component such that the mill, shaft turbines and inner shaft blades remove sand screen fill in the sand screen.

DETAILED DESCRIPTION OF THE INVENTION

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, on the claimed invention.

Figure 1:
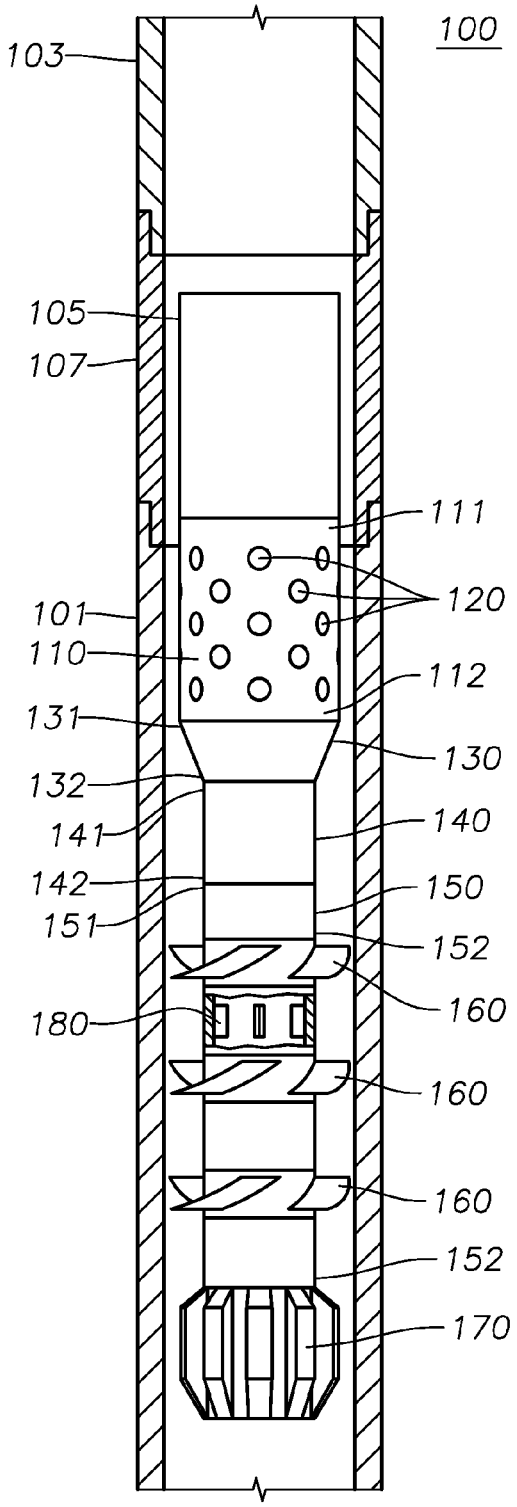
FIG. 1 shows a continuous down hole sand screen fill removal apparatus with a partial section view portion, according to an embodiment of the invention.

In some embodiments, the invention provides a continuous down hole sand screen fill removal apparatus 100. An exemplary embodiment of the apparatus is shown in FIG. 1. The apparatus 100 includes a perforated component 110 having perforations 120 that are operable to allow the flow of reservoir fluids. The perforated component 110 also has a top perforated component portion 111 and a bottom perforated component portion 112. The apparatus 100 also has a transition component 130 that has a top transition component portion 131 having a top transition component portion outer diameter and a bottom transition component portion 132 having an a bottom transition component portion outer diameter that is less than the top transition component portion outer diameter. The apparatus 100 also has a shaft component 150 that has a distal shaft component portion 152 and a proximal shaft component portion 151. The apparatus further includes a swivel component 140 that is operable to rotate the shaft component 150 without rotating the perforated component 110. The swivel component 140 has a top swivel component portion 141 and bottom swivel component portion 142. The apparatus 100 also includes at least one turbine component 160 and a mill component 170 that is operable to remove fill in sand screen 101. In the embodiment shown in FIG. 1, there are three turbine components 160. However, additional turbine components 160 may be added.

In the apparatus, the bottom perforated component portion 112 is adapted to be connected to the top transition component portion 131. The bottom transition component portion 132 is adapted to be connected to the top swivel component portion 141. The proximal shaft component portion 151 is adapted to be connected to the bottom swivel component portion 142. The at least one turbine component 160 is coupled to the shaft component 150 such that the at least one turbine component 160 is operable to rotate the shaft component 150. The mill component 170 is adapted to be connected to the distal shaft component portion 152. The apparatus is adapted to be placed in sand screen 101 in a down hole environment. Additional sand screens, e.g. sand screen 103, may also be located above or below the apparatus 100.

In some embodiments, the shaft component 150, swivel component 140, mill component 170, perforated component 110 and transition component 130 are all made of a solid material and hollow from the inside in a pile like manner. This allows fluid to flow through them. In further embodiments, the shaft is rigid with a fixed length and cannot move longitudinally.

The perforated component allows the fluid that enters the screen (which houses the apparatus) to move to the upper screens and therefore provide a continuous current that will energize the turbines.

The top swivel component 141 fits within the transition component 130. The bottom transition component portion 132 is adapted to be connected to the top swivel component portion 141. In some embodiments, the bottom transition component portion 132 is adapted to be threadingly engaged to the top swivel component portion 141. In further embodiments, the bottom transition component portion 132 and top swivel component portion 141 have an elastomer seal between them to further secure the connection.

In some embodiments, the turbine component 160 includes at least two turbine components 160. In further embodiments, the turbine component 160 includes at least three turbine components 160. The angle of the blades of the turbine component 160, number of blades of the turbine component 160, and the metallurgy of the turbine component 160 can be selected by a person of skill in the art who will understand that turbines are designed based on the different situations, i.e., for corrosive environments, corrosion resistant alloys may be preferred, and depending on the severity of the fill, the number of turbines and angle of blades can be designed to fit specific cases.

In another embodiment, the invention provides a method of using the continuous down hole sand screen fill removal apparatus 100. The method includes the steps of placing the continuous down hole sand screen fill removal apparatus 100 in a sand screen 101 in a wellbore in a down hole region and then allowing the flow of a gas from the down hole region across the continuous down hole sand screen fill removal apparatus causing the at least one turbine component 160 to rotate the shaft component 150. Additionally, the rotation of the shaft component 150 operates in such a fashion to rotate the mill component 170 such that the mill component 170 and the turbine components 160 remove sand screen fill in sand screen 101. In some embodiments, the shaft component 150 may have inner shaft blades 180 (FIG. 1) located on an inner diameter of a bore of the shaft component 150 to help break fill accumulation on the inside of the shaft component 150. The inner shaft blades 180 are of a small length and serve the purpose of breaking fill that may accumulate inside the shaft component 150. The metallurgy of inner shaft blades 180 may be the same as that of the shaft component 150 or higher strength metallurgy can be used as needed. The number and location of the inner shaft blades 180 can be selected as needed, depending on the severity of the fill that accumulates inside of the shaft component 150. The size, shape and location of the inner shaft blades 180 can be selected so that they do not prevent coiled tubing access within the shaft component 150, if needed.

In further embodiments, the mill component 170 is designed such that it does not touch the base pipe of the sand screen 101. Likewise, in some embodiments, the rotors spin inside the sand screen 101 but do not touch or brush up against the base pipe of the sand screen 101. Embodiments of this invention can be used with any type of sand screen known in the art.

In a further embodiment, the method includes placing a tubing nipple 107 apparatus in a screen joint of the sand screen 101 before the step of placing the continuous down hole sand screen fill removal apparatus 100 in the sand screen 101, wherein the continuous down hole sand screen fill removal apparatus 100 is held in place in the sand screen 101 by the tubing nipple 107 apparatus.

Any known tubing nipples 107 can be used in embodiments of the present invention. In further embodiments; the tubing nipple 107 apparatus is an R-nipple.

Figure 2:
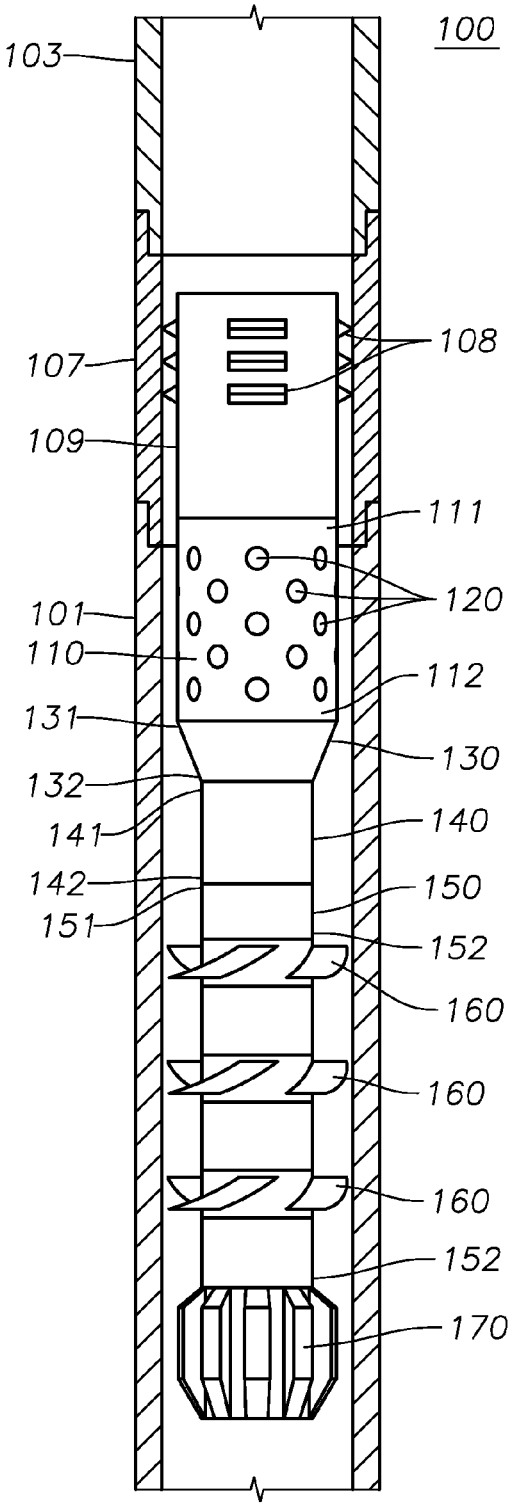
FIG. 2 shows a continuous down hole sand screen fill removal apparatus according to an alternate embodiment of the invention.

In further embodiments, as shown in FIG. 2, the continuous down hole sand screen fill removal apparatus 100 is attached to tubing plug 109 the before the step of placing the continuous down hole sand screen fill removal apparatus 100 in the sand screen 101. The tubing plug 109 is a flow-through tubing plug such that a continuous current will flow through and spin the turbine component 160. In certain embodiments, a benefit of tubing plug 109 is that it can be threaded to the apparatus 100, run down hole and set inside the sand screen 101 without the need to have tubing nipple 107, as some tubing plugs 109 have slips 108, e.g. metal teeth, that engage the casing causing tubing plug 109 and apparatus 100 to be stationary inside the screen.

Figure 3:
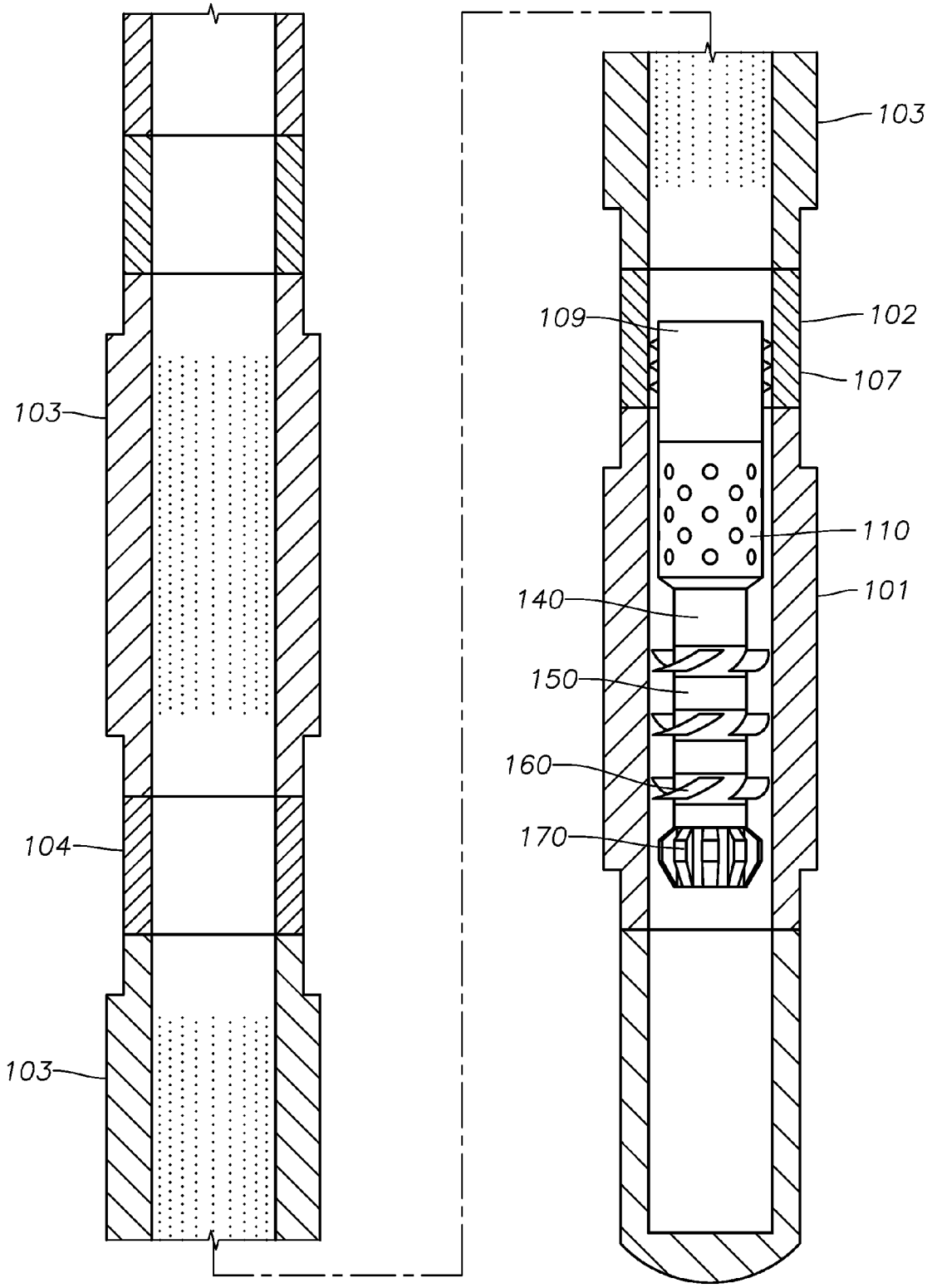
FIG. 3 shows a continuous down hole sand screen fill removal apparatus according to an alternate embodiment of the invention.

In further embodiments, the sand screen has multiple joints, including a last screen joint 102, as shown in FIG. 3. In further embodiments, continuous down hole sand screen fill removal apparatus 100 is set inside the last screen joint 102 of sand screen 101. In further embodiments, the continuous down hole sand screen fill removal apparatus 100 is set inside the any screen joint, e.g., screen joint 104.

In further embodiments, a lock mandrel 105 is used to secure the continuous down hole sand screen fill removal apparatus 100 in place in a well. In such an embodiment, the lock mandrel 105 is located on top of sand screen 101 where the apparatus is to be installed. The apparatus 100 then extends from the lock mandrel 105 to inside the end of the end sand screen joint 102. The lock mandrel 105 is used to lock inside the tubing nipple 107. A person of skill in the art will understand how to select a lock mandrel for use in embodiments of the present invention.

Embodiments of this invention utilize the energy of gas flow from the reservoir inside the sand screen to rotate the at least one turbine such that it provides continuous agitation and milling to prevent fill from accumulating in well completions.

In some embodiments, the apparatus described herein is for use in vertical applications. In other embodiments, the invention can be used in horizontal applications, such as in low dog leg severities (e.g., locations close to the vertical section).

Embodiments of this invention provide the means to prevent the accumulation of fill in completions at a lower cost than prior methods and results in uninterrupted oil and gas production from a well.

In further embodiments, the apparatus can be used in open hole operations.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

As used herein and in the appended claims, the words "comprise," "has," and "include" and all grammatical variations thereof are each intended to have an open, non-limiting meaning that does not exclude additional elements or steps.

As used herein and in the appended claims, the words "upper" and "lower" are intended to identify different ends of a given component and are not to be construed as limiting the orientation of a component or the apparatus.

That which is claimed is:

1. A continuous down hole sand screen fill removal apparatus comprising:

a perforated component having perforations to allow flow of reservoir fluids, the perforated component having a top perforated component portion and a bottom perforated component portion;

a transition component having a top transition component portion having a top transition component portion outer diameter and a bottom transition component portion having a bottom transition component portion outer diameter, wherein the bottom transition component portion outer diameter is less than the top transition component portion outer diameter;

a shaft component having a distal shaft component portion and a proximal shaft component portion;

a swivel component to enable rotation the shaft component having a top swivel component portion and bottom swivel component portion;

at least one turbine component;

a mill component to remove fill in a sand screen;

wherein the bottom perforated component portion connects to the top transition component portion, the bottom transition component portion connects to the top swivel component portion, the proximal shaft component portion connects to the bottom swivel component portion; the at least one turbine component is coupled to the shaft component such that the at least one turbine component rotates the shaft component; the mill component connects to the distal shaft component portion;

the continuous down hole sand screen fill removal apparatus is placed in a sand screen in a down hole environment.

2. The continuous down hole sand screen fill removal apparatus of claim 1 wherein the least one turbine component comprises at least two turbines.

3. The continuous down hole sand screen fill removal apparatus of claim 1 wherein the at least one turbine component comprises at least three turbines.

4. A method of using the continuous down hole sand screen fill removal apparatus of claim 1, comprising the steps of:

placing the continuous down hole sand screen fill removal apparatus in a sand screen in a wellbore in a down hole region;

allowing flow of a gas from the down hole region across the continuous down hole sand screen fill removal apparatus such that the at least one turbine component rotates the shaft component, further such that the mill component is rotated by the shaft component and removes sand screen fill in the sand screen.

5. The method of claim 4, further comprising the steps of:

placing a tubing nipple apparatus above the screen joint that houses the continuous down hole sand screen fill removal apparatus, wherein the continuous down hole sand screen fill removal apparatus is held in place by a lock mandrel which locks onto the tubing nipple apparatus.

6. The method of claim 5, further comprising the step of:

attaching the continuous down hole sand screen fill removal apparatus to a tubing plug the before the step of placing the continuous down hole sand screen fill removal apparatus in the sand screen.

7. The method of claim 6, wherein the tubing plug is a flow-through tubing plug.

* * * * *